US010118283B2

(12) United States Patent
Wolf et al.

(10) Patent No.: US 10,118,283 B2
(45) Date of Patent: Nov. 6, 2018

(54) HAND-HELD TOOL

(71) Applicant: Hilti Aktiengesellschaft, Schaan (LI)

(72) Inventors: Iwan Wolf, Untervaz (CH); Harald Fielitz, Lindau (DE); Klaus Bertsch, Frastanz (AT)

(73) Assignee: Hilti Aktiengesellschaft, Schaan (LI)

( * ) Notice: Subject to any disclaimer, the term of this patent is extended or adjusted under 35 U.S.C. 154(b) by 726 days.

(21) Appl. No.: 14/423,229

(22) PCT Filed: Aug. 21, 2013

(86) PCT No.: PCT/EP2013/067359
§ 371 (c)(1),
(2) Date: Feb. 23, 2015

(87) PCT Pub. No.: WO2014/029796
PCT Pub. Date: Feb. 27, 2014

(65) Prior Publication Data

US 2015/0298307 A1 Oct. 22, 2015

(30) Foreign Application Priority Data

Aug. 24, 2012 (DE) ..... 10 2012 215 126

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC ..... B25C 1/00; B25C 1/008; B25C 1/06
USPC ..... 227/8
See application file for complete search history.

(56) References Cited

U.S. PATENT DOCUMENTS 4,108,345 A * 8/1978 Manganaro ..... B25C 1/06 227/131
4,298,072 A * 11/1981 Baker ..... B25C 1/06 173/13
4,970,819 A * 11/1990 Mayhak ..... F41A 17/066 42/70.01
5,461,812 A * 10/1995 Bennett ..... F41A 17/063 42/70.06

(Continued)

FOREIGN PATENT DOCUMENTS

DE 10 2010 030 825 A1 1/2012
EP 0 736 360 A2 9/1996

(Continued)

OTHER PUBLICATIONS

International Search Report PCT/EP2013/067359, dated Jul. 17, 2014.

(Continued)

*Primary Examiner* — Gloria R Weeks
(74) *Attorney, Agent, or Firm* — Leydig Voit & Mayer

(57) ABSTRACT

The invention relates to a hand-held tool for driving fastening elements into a base, the tool having an initiating device, the actuation of which initiates a drive-in action and which can be blocked, depending on at least one state of the tool. In order to further simplify or improve the operation of the hand-held tool, a lifting magnet, associated with the initiating device, can block or enable the actuation of the initiating device.

16 Claims, 2 Drawing Sheets

(56) References Cited

U.S. PATENT DOCUMENTS 5,546,690 A * 8/1996 Ciluffo ..... F41A 17/066 340/5.52
5,560,135 A * 10/1996 Ciluffo ..... F41A 17/066 42/70.07
5,636,464 A * 6/1997 Ciluffo ..... F41A 17/066 340/5.52
5,772,096 A * 6/1998 Osuka ..... B25C 1/008 227/130
6,237,271 B1 * 5/2001 Kaminski ..... F41A 17/063 42/70.01
6,293,039 B1 * 9/2001 Fuchs ..... F41A 17/04 42/70.04
6,691,907 B1 * 2/2004 Chang ..... B25C 1/008 227/130
6,695,193 B1 * 2/2004 Chang ..... B25C 1/041 227/130
6,695,194 B1 2/2004 Chang
7,469,811 B2 * 12/2008 Shima ..... B25C 1/06 227/131
7,922,054 B2 * 4/2011 Cole, Jr. ..... B25C 1/008 227/123
8,042,717 B2 * 10/2011 Lam ..... B25C 1/008 227/120
8,205,372 B2 * 6/2012 Anzeloni ..... F41A 17/063 42/70.01
8,267,298 B2 * 9/2012 Zahner ..... B25C 1/08 227/10
2010/0116863 A1 * 5/2010 Suda ..... B25C 1/008 227/8
2011/0132959 A1 * 6/2011 Hlinka ..... B25C 1/008 227/8
2012/0000682 A1 1/2012 Grazioli
2012/0067934 A1 * 3/2012 Li ..... B25C 1/008 227/8
2012/0074195 A1 * 3/2012 Chien ..... B25C 1/06 227/147

FOREIGN PATENT DOCUMENTS

EP 2 450 152 A2 9/2012
JP 2009-56566 A 3/2009
TW M242337 U 9/2004
TW I221798 B 10/2004

OTHER PUBLICATIONS

Taiwanese Patent Office, Office Action in counterpart Taiwanese Application No. 102126252, dated Nov. 30, 2017.

* cited by examiner

HAND-HELD TOOL

TECHNICAL FIELD

The invention relates to a hand-held tool for driving fastening elements into a base, the tool having an initiating device, the actuation of which initiates a driving process and which can be blocked depending on at least one tool state.

BACKGROUND OF THE INVENTION

U.S. Pat. No. 7,922,054 B2 discloses a device for exerting an impact onto a fastening element, the device comprising an initiator mechanism for initiating a setting process and an initiator deactivation mechanism for deactivating the initiator mechanism.

BRIEF SUMMARY OF THE INVENTION

The problem addressed by the invention is that of further simplifying or improving the operation of a hand-held tool for driving fastening elements into a base.

The problem is solved for a hand-held tool for driving fastening elements into a base, the tool having an initiating device, the actuation of which initiates a driving process and which can be blocked depending on at least one tool state, characterized in that an electrically actuatable mechanical blocking device, with which actuation of the initiating device can be blocked or released, is associated with the initiating device. The initiating device preferably comprises an initiating switch, which is also referred to as a trigger. The initiating device is preferably designed as a lifting magnet, especially preferably an electromagnet, and is electrically actuatable via an internal controller in the device. The initiating device can be quickly and safely blocked or released by the lifting magnet. The hand-held tool is preferably designed as a bolt-setting tool. The bolt-setting tool can be operated electrically, pneumatically or with a fuel. In the electrical version, the bolt-setting tool preferably comprises a spring device serving as an interim storage device for storing energy that originates from an electrical drive unit in the bolt-setting device and is abruptly output during a setting process.

A preferred embodiment of the hand-held tool is characterized in that the blocking device comprises a tappet that acts mechanically on an initiating switch of the initiating device. The tappet is preferably movable back-and-forth by electrical actuation of the blocking device, the movement preferably being linear or, likewise preferred, about a pivot shaft.

An additional preferred embodiment of the hand-held tool is characterized in that the tappet is movable between a blocking position, in which the initiating switch is blocked, and a release position, in which the initiating switch is released. The tappet preferably moves linearly or, likewise preferred, about a pivot shaft. Due to the direct action of the tappet on the initiating switch, an elaborate mechanism can be dispensed with.

Another preferred embodiment of the hand-held tool is characterized in that the blocking device is mechanically coupled to a transmission element, which in turn acts mechanically on the initiating device. The transmission element is preferably used to constitute the blocking function and the release function.

Another preferred embodiment of the hand-held tool is characterized in that the transmission element has a recess, the position of which relative to the initiating device can be varied by the blocking device. Thereby the initiating device can be blocked or released in a simple manner.

An additional preferred embodiment of the hand-held tool is characterized in that the recess is positioned in a receiving position relative to the initiating device such that an actuator of the initiating device engages upon actuation with the recess, without initiating a movement of the transmission element. The transmission element can advantageously be pre-tensioned into its receiving position. Thereby a fail-safe solution can be constituted in a simple manner.

An additional preferred embodiment of the hand-held tool is characterized in that the recess is positioned in an initiating position relative to the initiating device such that during actuation, an actuator of the initiating device initiates a movement of the transmission element. In the initiating position, the actuator of the initiating device is not engaged with the recess on the transmission element.

Another preferred embodiment of the hand-held tool is characterized in that the transmission device is designed as a lever, which is acted upon in the longitudinal direction by the blocking device, and in the transverse direction by the initiating device. The lever can be articulatedly mounted at an end facing the blocking device. At an end facing away from the blocking device, the lever can be coupled, via a further coupling element for example, to a driving device in the tool.

An additional preferred embodiment of the hand-held tool is characterized in that the lifting magnet is connected for control purposes to a controller. The controller is integrated into the tool and is used to actuate the lifting magnet depending on at least one tool state.

An additional preferred embodiment of the hand-held tool is characterized in that the controller is connected to a contact pressure sensor. The contact pressure sensor is used for detecting whether the tool is being pressed against a base by a user.

An additional preferred embodiment of the hand-held tool is characterized in that the controller actuates the blocking device electrically such that the blocking device releases the actuation of the initiating device if the contact pressure sensor detects pressing of the hand-held tool against a base and that the blocking device blocks actuation of the initiating device if the contact pressure sensor does not detect pressing of the hand-held tool against a base.

An additional preferred embodiment of the hand-held tool is characterized in that the blocking device comprises an electromagnet and a lifting member. The lifting member preferably penetrates partially, particularly preferably completely, into the electromagnet. According to another preferred embodiment, the lifting member is arranged completely outside the electromagnet both in the blocking position and in the release position of the blocking device.

An additional preferred embodiment of the hand-held tool is characterized in that the tappet comprises the lifting member.

BRIEF DESCRIPTION OF THE SEVERAL VIEWS OF THE DRAWING(S)

Other advantages, features, and details of the invention can be deduced from the following description, in which various embodiments are described in detail with reference to the drawings. In the drawing.

DETAILED DESCRIPTION OF THE INVENTION

Figure 1:
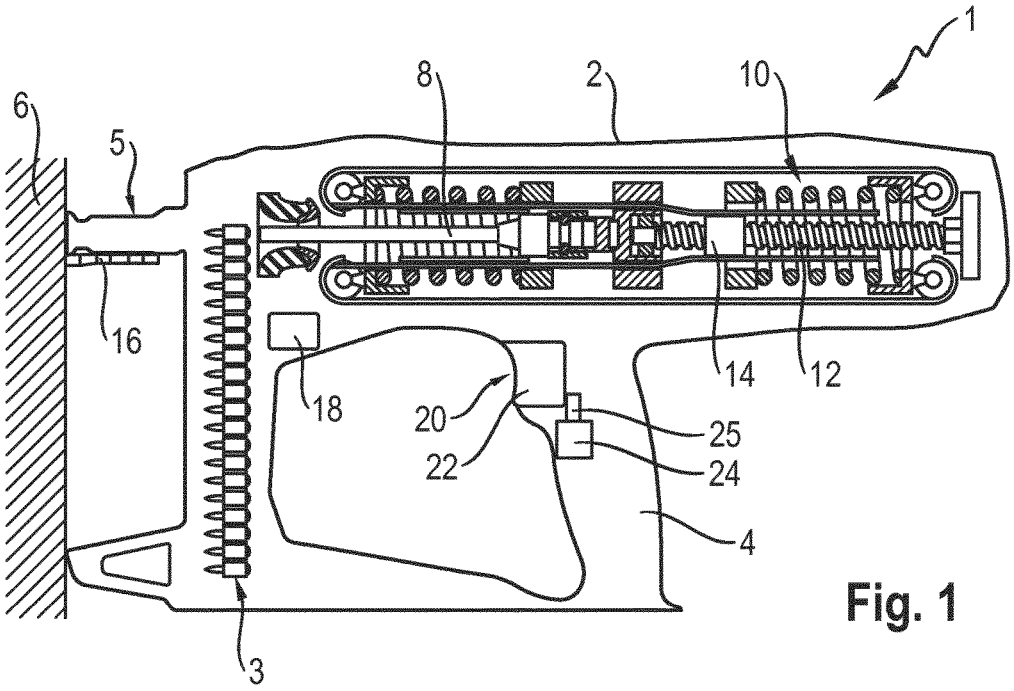
FIG. 1 shows a hand-held tool having an initiating device and a lifting magnet, in a blocking position.
Figure 2:
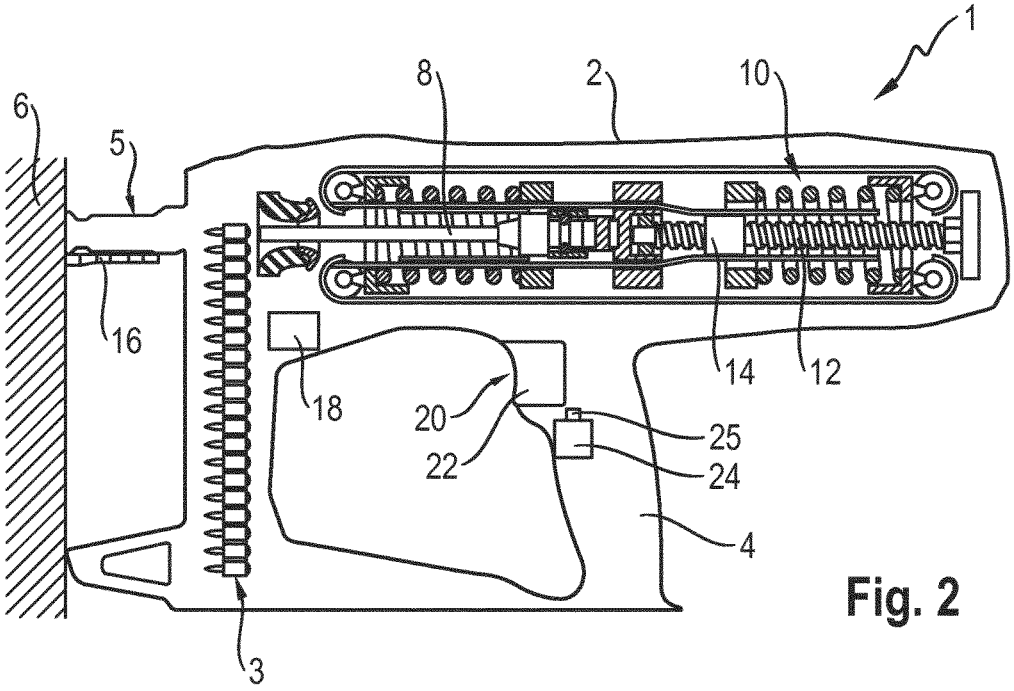
FIG. 2 shows the tool from FIG. 1 with the lifting magnet in a release position.

FIGS. 1 and 2 show a hand-held tool, designed as a bolt-setting tool 1, in two different states. The bolt setting tool 1 comprises a spring device 10 as a drive element and is therefore also referred to as a spring nailer. The spring device 10 is cocked by an electric motor that drives a spindle 12. The spindle 12 is arranged together with a spindle nut 14 in a housing 2 of the tool 1.

The housing 2 comprises a magazine 3 for fastening elements, more particularly bolts, of which a supply is contained in the magazine. The bolt setting device 1 further comprises a handle 4, which can be gripped by a user's hand. The fastening elements 3 exit from the tool 1 at a bolt-setting end 5 and are driven by means of a tappet rod 8 into a base 6.

A contact pressure sensor 16 is arranged at the bolt setting end 5 of the tool 1. The contact pressure sensor 16 detects whether the tool 1 is being pressed against the base 6 during use by a user. The contact pressure sensor 16 is connected for control purposes to a controller 18. The controller 18 is in turn connected for control purposes to an initiating device 20 of the tool 1, wherein the control is performed electronically. In an embodiment that is not shown, the control is performed mechanically. The initiating device 20 comprises an initiating switch 22, which is also referred to as a trigger.

As can be seen in FIG. 1, the initiating switch 22 can be blocked by a lifting magnet 24 constructed as an electromagnet. The lifting magnet 24 has a tappet 25 that acts directly on the initiating switch 22. In FIG. 1, the tappet 25 of the lifting magnet 24 is in its blocking position, in which the initiating switch 22 is blocked. In FIG. 2, the tappet 25 of the lifting magnet 24 is in the release position, in which the initiating switch 22 is released. A lifting element of the tappet 25 penetrates completely into the lifting magnet 24.

The lifting magnet 24 is released or blocked by the controller 18 depending on a contact pressure signal from the contact pressure sensor 16. In place of the contact pressure signal from the contact pressure sensor 16, other internal signals of the device, particularly electrical or mechanical signals, can be used to control the magnet 24.

Figure 3:
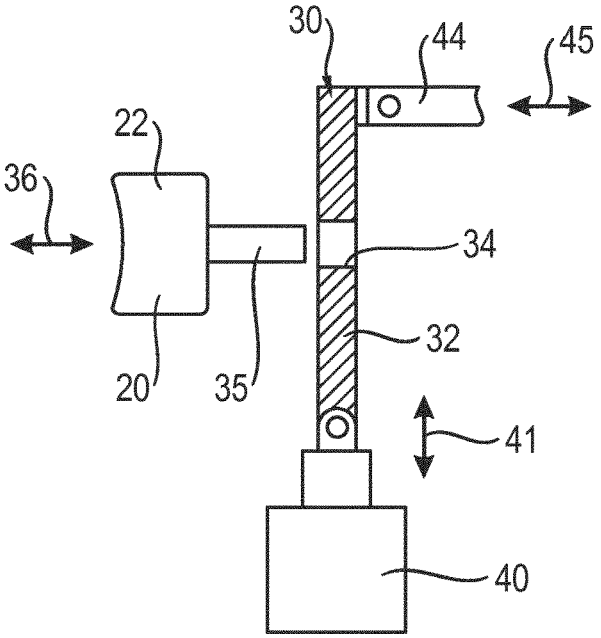
FIG. 3 shows a detailed representation of the initiating device with the lifting magnet according to an additional embodiment.

In FIG. 3, the initiating switch 22 of the initiating device 20 in the tool illustrated in FIG. 1 is coupled via a transmission element 30 to a lifting magnet 40. The transmission element 30 is actuated by the lifting magnet 40. Depending on the position of the transmission element 30, the initiating switch 22 of the initiating device 20 is blocked or released.

The transmission element 30 comprises a lever 32, which is articulated at the lower end thereof shown in FIG. 3 to a support structure (not shown) or to the lifting magnet 40. At the upper end of the lever 32 in FIG. 3, the transmission element is articulated to a coupling element 44. The lever 32 further comprises, between the two ends thereof, a recess 34 formed as a through-hole.

An actuator 35, which is formed on the initiating switch 22, is associated with the recess 34. A double arrow 36 indicates that the actuator 35 is moved during actuation of the initiating device 20 translationally, to the right and the left in FIG. 3.

The transmission element 30 is in its receiving position in FIG. 3. In the receiving position, the recess 34 of the lever 32 is positioned relative to the actuator 35 of the initiating device 20 in such a manner that the actuator 35 is moved into the recess 34 during an actuation of the initiating switch 22. The initiating switch 22 moves into empty space, so to speak. No movement of the lever 32 is initiated by the initiating switch 22.

A double arrow 41 indicates that the lever 32 can be moved by the lifting magnet 40 translationally upward or downward in the longitudinal direction of the lever 32. If the lever 32 in FIG. 3 is moved upward or downward, then the lever 32 occupies a release position in which an actuation of the initiating switch 22 initiates a movement of the lever 32. This movement of the lever 32 is transmitted via the coupling element 44 to the driving mechanism of the tool 1, as indicated by a double arrow 45.

Figure 4:
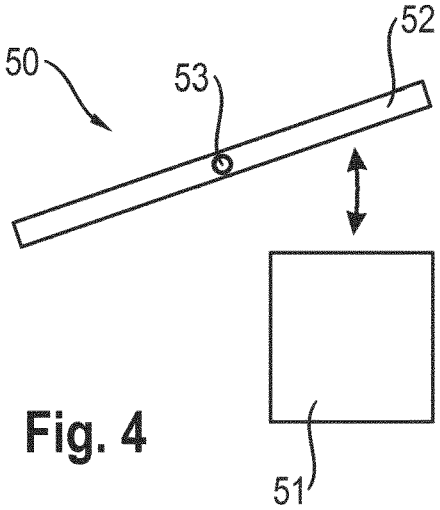
FIG. 4 shows an additional embodiment of a blocking device.

According to FIG. 4, a blocking device 50 comprises an electrically actuatable electromagnet 51 and a lifting member 52, which is arranging completely outside of the electromagnet 51 in all operating positions and is articulated on a pivot shaft 53. The lifting member 52 is preferably produced from a ferromagnetic or permanently magnetic material.

Figure 5:
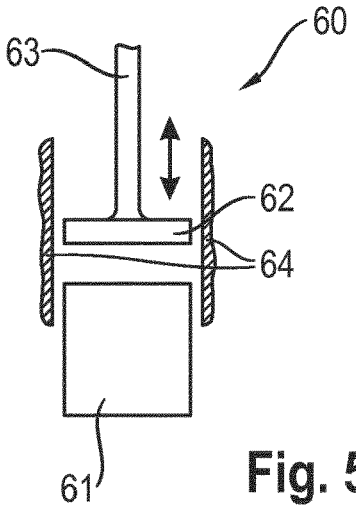
FIG. 5 shows an additional embodiment of a blocking device.

According to FIG. 5, a blocking device 60 has an electrically actuatable electromagnet 61 and a lifting member 62 arranged completely outside the electromagnet 61 in all operating positions. The lifting member 62 is designed as a piston that is movable in a guide 64 and is connected rigidly to a tappet 63, the lifting member 62 and in particular the tappet 63 being preferably produced from a ferromagnetic or permanent magnetic material.

Figure 6:
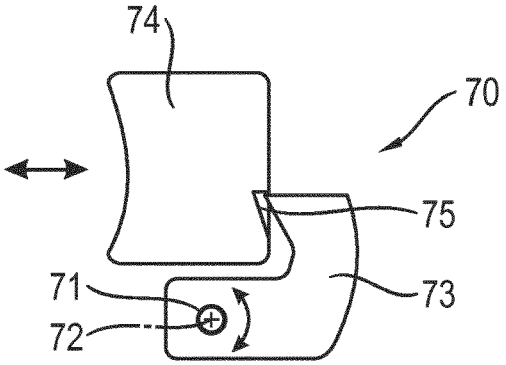
FIG. 6 shows an additional embodiment of a blocking device.

According to FIG. 6, a blocking device 70 has an electrically actuatable actuator 71 and a pivot lever 73 that is movable rotationally about a pivot shaft 72 and is articulated to the pivot shaft 72. The pivot lever 73 acts mechanically directly on an initiating switch 74 that, for increased safety, preferably has a recess 75 with which the pivot lever 73 engages in the blocking position. A contour of the recess 75 is matched to a contour of the pivot lever 73.

The invention claimed is:

1. A hand-held tool for driving fastening elements into a base, comprising an initiating device, the actuation of which initiates a driving process and which can be blocked depending on at least one tool state; and an electrically actuatable mechanical blocking device with which actuation of the initiating device can be blocked or released, wherein the actuatable mechanical blocking device is mechanically coupled to a transmission element, which in turn acts mechanically on the initiating device, the transmission element having a recess, the recess having a position relative to the initiating device that can be varied by the blocking device, wherein the initiating device comprises an actuator and the recess is positioned in a receiving position relative to the initiating device such that the actuator engages during actuation with the recess, without initiating a movement of the transmission element, and wherein the recess is positioned in an initiating position relative to the initiating device such that, when actuating the initiating device, the actuator initiates a movement of the transmission element and initiates a driving process.

2. The hand-held tool according to claim 1, wherein the blocking device comprises a tappet that acts mechanically on an initiating switch of the initiating device.

3. The hand-held tool according to claim 2, wherein the tappet is movable between a blocking position, in which the initiating switch is blocked, and a release position, in which the initiating switch is released.

4. The hand-held tool according to claim 3, wherein the tappet is movable linearly between the blocking position and the release position.

5. The hand-held tool according to claim 3, wherein the tappet is moveable about a pivot shaft between the blocking position and the release position.

6. The hand-held tool according to claim 3, wherein the blocking device is mechanically coupled to a transmission element, which in turn acts mechanically on the initiating device.

7. The hand-held tool according to claim 2, wherein the blocking device is mechanically coupled to a transmission element, which in turn acts mechanically on the initiating device.

8. The hand-held tool according to claim 1, wherein the transmission element comprises a lever, which is acted upon in a longitudinal direction by the blocking device, and in a transverse direction by the initiating device.

9. The hand-held tool according to claim 1, wherein the blocking device is connected to a controller for control purposes.

10. The hand-held tool according to claim 9, wherein the controller is connected to a contact pressure sensor.

11. The hand-held tool according to claim 10, wherein the controller actuates the blocking device electrically such that the blocking device releases the actuation of the initiating device if the contact pressure sensor detects pressing of the hand-held tool against a base, and that the blocking device blocks actuation of the initiating device if the contact pressure sensor does not detect pressing of the hand-held tool against a base.

12. The hand-held tool according claim 1, wherein the blocking device comprises an electromagnet and a lifting member.

13. The hand-held tool according to claim 12, wherein the lifting member penetrates into the electromagnet.

14. The hand-held tool according to claim 12, wherein the lifting member is arranged completely outside of the electromagnet, both in a blocking position and in a release position of the blocking device.

15. The hand-held tool according to claim 12, wherein the initiating device comprises an initiating switch, and the blocking device comprises a tappet that acts mechanically on the initiating switch and the tappet comprises the lifting member.

16. The hand-held tool according to claim 5, wherein the transmission element comprises a lever, which is acted upon in a longitudinal direction by the blocking device, and in a transverse direction by the initiating device.

* * * * *